US005090344A

United States Patent [19]

Wang

[11] Patent Number: 5,090,344

[45] Date of Patent: Feb. 25, 1992

[54] PRESSER OF A SEWING MACHINE

[76] Inventor: Shui-Nu Wang, No. 6, Nan Pin Road, Taichung, Taiwan

[21] Appl. No.: 729,074

[22] Filed: Jul. 15, 1991

[51] Int. Cl.[5] ..... D05B 35/10; D05B 29/06

[52] U.S. Cl. ..... 112/151; 112/153; 112/235

[58] Field of Search ..... 112/235, 151, 153, 60, 112/240, 150

[56] References Cited

U.S. PATENT DOCUMENTS

| | | | |
|---|---|---|---|
| 2,241,778 | 5/1941 | Giancola | 112/235 |
| 2,478,032 | 8/1949 | Wallsh | 112/235 X |
| 2,645,194 | 7/1953 | Underwood | 112/153 |
| 2,711,704 | 6/1955 | Maczuga et al. | 112/153 |
| 3,028,822 | 4/1962 | Hollister et al. | 112/153 |
| 3,203,382 | 8/1965 | Micale | 112/235 X |
| 4,473,019 | 9/1984 | Hanyu et al. | 112/235 |
| 4,494,471 | 1/1985 | Zylbert | 112/235 |
| 4,532,874 | 8/1985 | Eguchi et al. | 112/235 |
| 4,862,816 | 9/1989 | Hanyu et al. | 112/235 X |
| 4,899,677 | 2/1990 | Frey et al. | 112/151 |

FOREIGN PATENT DOCUMENTS

| | | | |
|---|---|---|---|
| 62-002997 | 1/1987 | Japan | 112/235 |

*Primary Examiner*—Werner H. Schroeder
*Assistant Examiner*—Paul C. Lewis

[57] ABSTRACT

A presser of a sewing machine including a body movable downward for pressing a cloth which includes one side edge, a rod laterally extended from the body, a bolt rotatably supported on the rod, and a guide including a back extended downward from one side of the guide for guiding the side edge of the cloth and a frame having a screw hole for threaded engagement with the bolt, so that the guide can be caused to move along a longitudinal direction of the rod and so that the back can be adjusted relative to the body by rotation of the bolt.

1 Claim, 2 Drawing Sheets

PRESSER OF A SEWING MACHINE

BACKGROUND OF THE INVENTION (a) Field of the Invention

The present invention relates to a presser, and more particularly to a presser of a sewing machine.

(b) Description of the Prior Art

Typical presser of a sewing machine is provided for pressing the cloth to be sewed and is shown in FIG. 4. The presser comprises a body 10 movable downward in order to press the cloth 50 to be sewed during sewing operations and having a seat 11 formed thereon, the body 10 having a recess 12 formed therein, through which a needle (not shown) is passed in a reciprocating action in order to conduct sewing operations; and a guide 40 having an oblong hole 43 formed therein, through which a bolt 41 is engaged in order to fix the guide 40 to the seat 11 of the body 10. The guide 40 includes a back 42 extended downward therefrom for guiding one side edge 51 of the cloth to be sewed, in which the side edge 51 of the cloth 50 is disposed in parallel to the feeding direction of the cloth 50. The back 42 is adjusted relative to the body 10 in order to determine the distance between the side edge 51 of the cloth 50 and the stitches to be sewed on the cloth 50. However, in order to adjust the distance between the back 42 and the body 10, the bolt 41 should be unthreaded first, and then adjust the guide 40 relative to the body 10, and then fix the bolt 41 again such that the guide 40 can be fixed in place again. This is very inconvenient. In addition, the guide 40 can not be finely and precisely adjusted relative to the body 10.

The present invention has arisen to mitigate and/or obviate the afore-described disadvantages of the conventional pressers of the sewing machine.

SUMMARY OF THE INVENTION

The primary objective of the present invention is to provide a presser of a sewing machine in which the guide can be finely and easily adjusted relative to the body of the presser.

In accordance with one aspect of the present invention, there is provided a presser of a sewing machine including a body movable downward for pressing a cloth which includes one side edge, a rod laterally extended from the body, a bolt rotatably supported on the rod, and a guide including a back extended downward from one side of the guide for guiding the side edge of the cloth, and a frame having a screw hole for threaded engagement with the bolt, the guide can be caused to move along the longitudinal direction of the rod when the bolt is rotated by the user so that the distance between the back and the body can be adjusted by rotation of the bolt.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
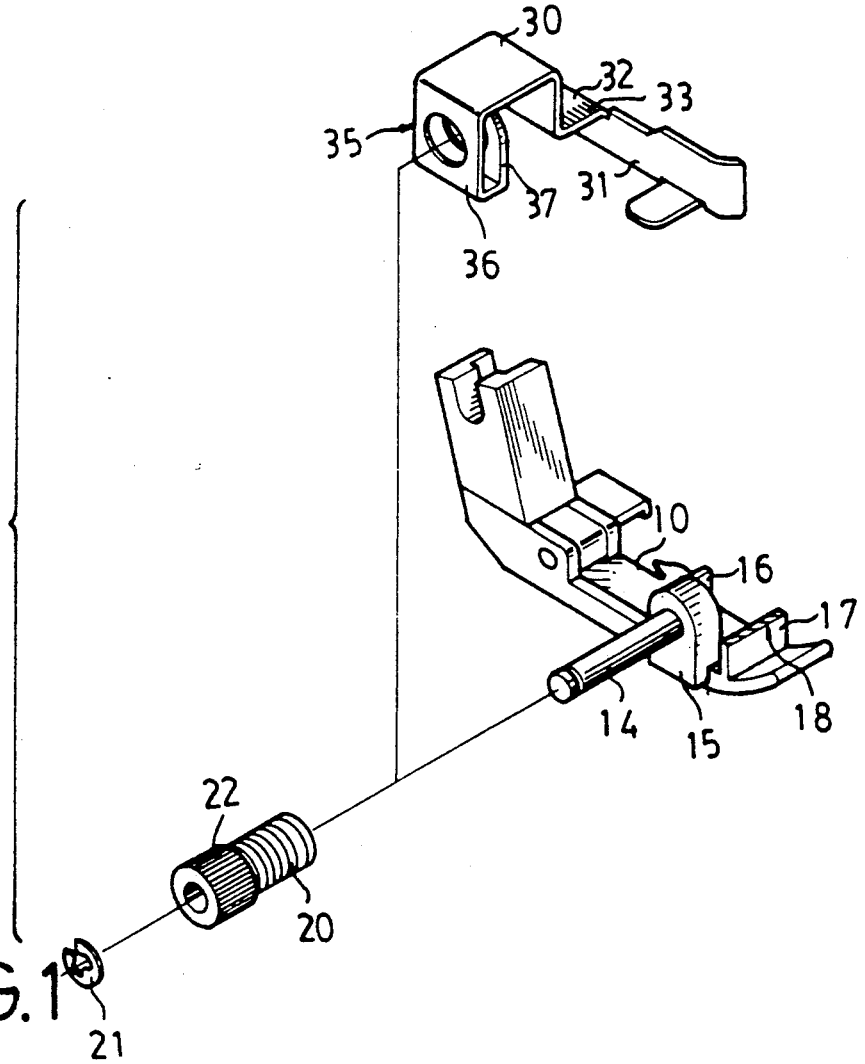
FIG. 1 is an exploded view of a presser in accordance with the present invention.
Figure 2:
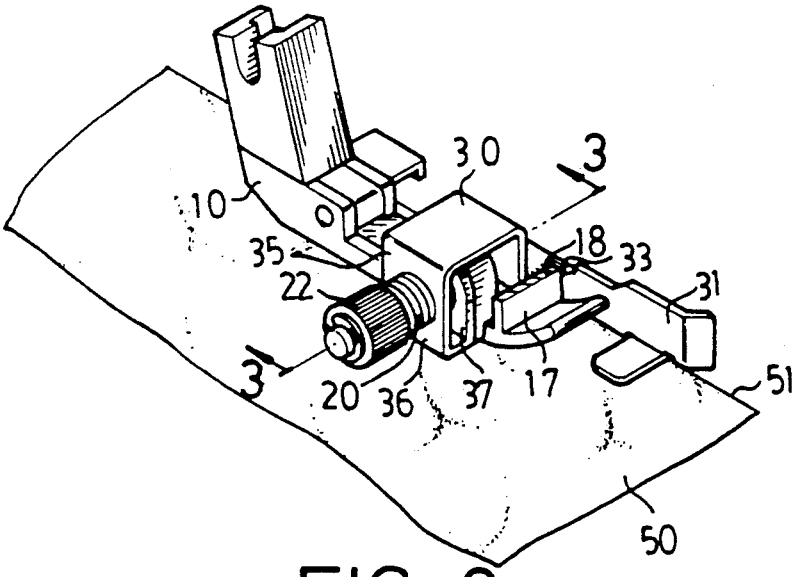
FIG. 2 is a perspective view of the presser.

Referring to the drawings and initially to FIGS. 1 and 2, the presser in accordance with the present invention comprises generally a body 10 movable downward for pressing the cloth 50 to be sewed during sewing operations; a bolt 20 rotatably supported on a rod 14 which is laterally extended from the body 10; and a guide 30 threadedly engaged with the bolt 20 for guiding the side edge 51 of the cloth 50. The guide 30 can be adjusted relative to the body 10 by the bolt 20.

The rod 14 is laterally extended from a stay 15 which is integrally fixed on the body 10. A pair of wall members 16, 17 are formed on the body 10 and located on both sides of the stay 15. One mark line or a plurality of mark lines 18 are provided on the upper surface of one of the wall members 17. The bolt 20 is rotatably supported on the rod 14 and maintained in place by a clamp ring 21 and includes a head 22 formed on one end thereof.

Figure 3:
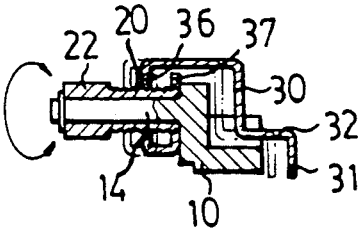
FIG. 3 is a cross sectional view taken along lines 3-3 of FIG. 2.
Figure 4:
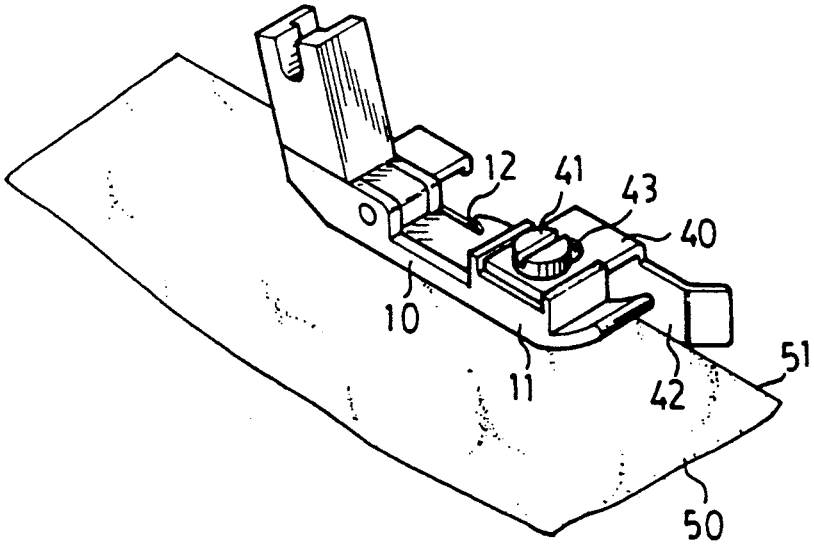
FIG. 4 PRIOR ART
FIG. 4 is a perspective view of the conventional presser of the sewing machine.

The guide 30 includes a back 31 extended downward from a platform 32 on which a plurality of mark lines 33 are formed. The platform 32 is guided to move between the wall members 16, 17 of the body 10, and the relative positions between the guide 30 and the body 10 can be determined by the marks 18, 33 formed on the wall member 17 and the platform 32 respectively. A frame 35 is substantially U-shaped including two plates 36, 37 each having a screw hole formed therein for engagement with the bolt 20 so that the guide 30 can be caused to move along the longitudinal direction of the rod 14 by the threaded engagement between the bolt 20 and the screw hole of the plates 36, 37, and so that the back 31 can be adjusted relative to the body 10 by rotation of the head 22 of the bolt 20, as shown in FIG. 3.

Alternatively, the frame 35 can be replaced by a board element or a block element or the like which has a screw hole formed therein for engagement with the bolt 20.

Accordingly, the back 31 of the presser in accordance with the present invention can be easily and finely and precisely adjusted relative to the body 10 of the presser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A presser of a sewing machine comprising a body movable downward for pressing a cloth which includes one side edge, said body including a pair of wall members formed thereon; a rod laterally extended from a stay which is integrally formed on said body; a bolt rotatably supported on said rod and immovable longitudinally relative to said rod; and a guide including a platform slidably received and guided between said wall members of said body, said platform including a first mark formed thereon, one of said wall members having a second mark formed on an upper surface thereof, a relative position between said back and said body can be determined by a relative position between said first mark of said platform and said second mark of said wall member, a back extended downward from said platform for guiding said side edge of said cloth, and a frame which has a substantially inverted U-shape including two plates each having a screw hole formed therein for threaded engagement with said bolt, whereby, said guide can be caused to move along a longitudinal direction of said rod and said back can be adjusted relative to said body by rotation of said bolt.

* * * * *